US005633615A

United States Patent [19]

Quan

[11] Patent Number: 5,633,615

[45] Date of Patent: May 27, 1997

[54] VERTICAL RIGHT ANGLE SOLDERLESS INTERCONNECTS FROM SUSPENDED STRIPLINE TO THREE-WIRE LINES ON MIC SUBSTRATES

[75] Inventor: Clifton Quan, Arcadia, Calif.

[73] Assignee: Hughes Electronics, Los Angeles, Calif.

[21] Appl. No.: 576,997

[22] Filed: Dec. 26, 1995

[51] Int. Cl.[6] ..... H01P 5/08

[52] U.S. Cl. ..... 333/33; 333/246

[58] Field of Search ..... 333/33, 246

[56] References Cited

U.S. PATENT DOCUMENTS 4,837,529 6/1989 Gawronski et al. ..... 333/33

4,995,815 2/1991 Buchanan et al. ..... 333/33 X 5,416,453 5/1995 Quan ..... 333/33 X

*Primary Examiner*—Paul Gensler

*Attorney, Agent, or Firm*—Leonard A. Alkov; Wanda K. Denson-Low

[57] ABSTRACT

An interconnection apparatus for providing solderless, three dimensional microwave interconnection from a planar suspended substrate stripline network to MIC modules using three wire transmission line input/output ports. The apparatus includes in sequence a coaxial line transition which is coupled to the stripline center conductor, a slabline transition coupled to the coaxial line transition. A center conductor having a constant diameter extends through the coaxial and slabline transition. A short three wire transition couples the slabline transition to the three wire transmission line input/output port, and uses compressible conductors as the wire elements to provide a robust solderless connection to the three wire transmission line port.

22 Claims, 6 Drawing Sheets

VERTICAL RIGHT ANGLE SOLDERLESS INTERCONNECTS FROM SUSPENDED STRIPLINE TO THREE-WIRE LINES ON MIC SUBSTRATES

TECHNICAL FIELD OF THE INVENTION

This invention relates to microwave circuit packaging, and more particularly to a technique for providing vertical solderless interconnection between microwave circuits with three wire transmission line input/output ports and suspended substrate stripline transmission lines.

BACKGROUND OF THE INVENTION

An application of this invention is to carry RF signals between vertically stacked modules of RF components/circuits. Conventional techniques include interconnecting modules with coaxial cables with connectors, mating coaxial push=on coaxial connectors, soldered ribbons or soldered flexible cables. The disadvantages of these techniques include size, weight and assembly costs. Such connection techniques require several process steps. More permanent connections include the use of epoxies and solders. Moreover, direct vertical connections from coaxial line to three-wire transmission lines have the effect of exciting additional, undesirable waveguide modes within the module.

SUMMARY OF THE INVENTION

This invention provides a new, more compact approach to microwave packaging. Separate, individual microwave modules can now be packaged vertically, with less volume than required for conventional packaging techniques. A direct transition can be made into three-wire line and operate "mode free" at microwave frequencies, i.e. free of higher order waveguide modes other than the fundamental TEM (transverse electromagnetic) mode.

In accordance with the invention, a microwave interconnection apparatus provides RF interconnection between a suspended stripline transmission line and a three wire transmission line, and includes a coaxial line transition coupled to the suspended stripline transmission line. The coaxial line transition includes a coaxial center conductor member and an outer conductor shield spaced from the center conductor and having a generally circular cross-sectional configuration. A dielectric filled slabline transition has a first port adjacent a port of the coaxial line transition, the slabline transition including a dielectric member, a slabline center conductor member and an outer conductive shield member defining a cavity in which the dielectric member is disposed, the cavity having a generally rectilinear cross-sectional configuration. The coaxial outer conductor shield is adjacent the slabline shield member.

The apparatus further includes a three wire transmission line transition section having a first port in electrical communication with a second port of the slabline transition and including a middle wire and respective first and second ground wires flanking the middle wire, the ground wires in electrical contact with the outer shield member of the slabline transition. A second port of the three wire transition section makes contact with the three wire transmission line.

The middle wire and first and second ground wires of the three wire transmission line transition section are compressible conductor members, to provide a robust contact with the three wire transmission line. In accordance with another aspect of the invention, the three wire transition section has an effective electrical length which does not exceed one tenth of a wavelength of operation of the interconnection apparatus.

BRIEF DESCRIPTION OF THE DRAWINGS

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENT

This invention in an exemplary implementation provides solderless three-dimensional (3-D) RF signal interconnection between planar suspended substrate stripline networks to MIC (microwave integrated circuit) modules using three-wire transmission line input/output (I/O) ports.

Figure 1:
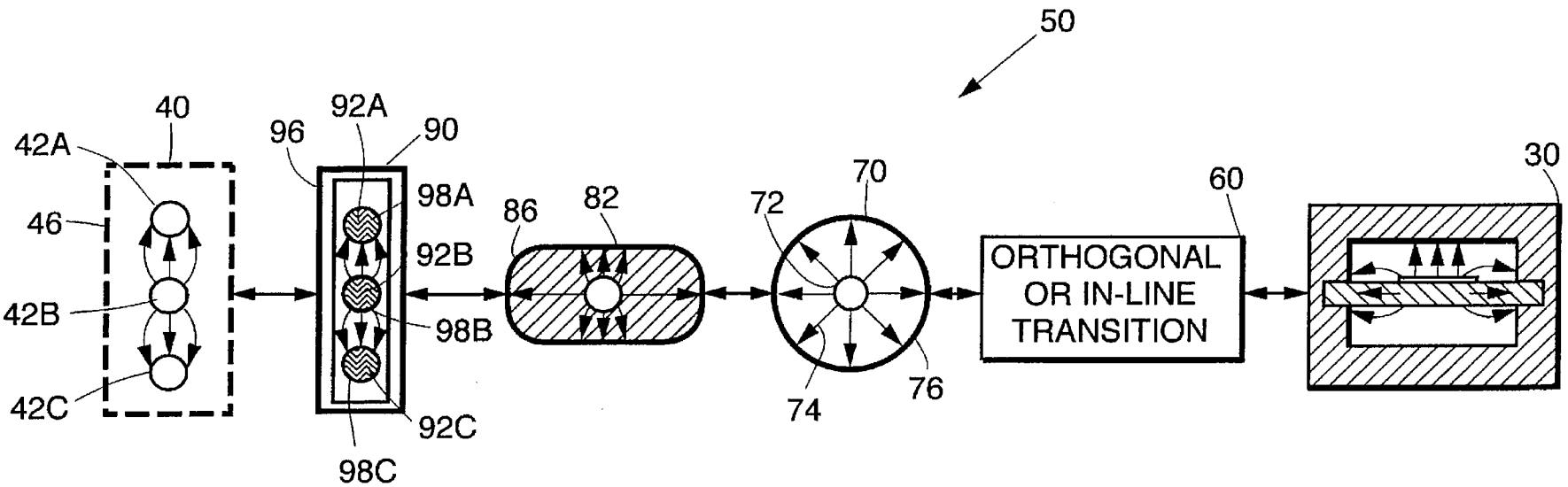
FIG. 1 is an exploded, partially broken-away isometric view of an exemplary interconnect apparatus in accordance with the invention.

FIG. 1 is a diagrammatic block diagram illustrating the RF transmission line path and components that make up an embodiment of the invention shown as interconnection apparatus 50. The purpose of each component is to route and reshape the electric fields from the suspended substrate stripline 30 so that the resulting electric fields of the RF signal will interface and resemble the three-wire line field configuration at the T/R module three-wire I/O port 40. RF signals traveling through the 50 ohm suspended substrate stripline 30 are vertically launched by orthogonal or in-line transition 60 into an air coaxial line 70 disposed transverse to the stripline 30 and whose impedance is designed to provide an inductance thus canceling any parasitic capacitance associated with orthogonal stripline bends. The impedance is determined either experimentally using a time domain reflectometer, or analytically using a three-dimensional electromagnetic structure simulation software, e.g. The "Eminence" program marketed by Ansoft Corporation, Pittsburgh, Pa. This impedance determination is well known to those skilled in the microwave circuit arts. The resulting RF signals from this matched vertical transition and coaxial line 70 have an electric field that is radially symmetric about the center conductor 72 of the coaxial line 70, as shown by field lines 74. While maintaining a constant radius in the center conductor 72, the coaxial outer conductor shield 76 is then reshaped from a shield having a circular cross-section to a shield 86 defining a thin rectangular cavity to form the 50 ohm slabline transition 80. Here, the center conductor 82 is the same diameter as the center conductor 72 of the coaxial line.

The resulting electric fields within the slabline transition 80 are oriented in the same direction and oriented in like fashion as the fields in the three-wire line 40. This similarity of field orientation and distribution produces a well matched transition from slabline to three-wire line. Added benefits of the slabline transmission line include the capability to incorporate translation offsets and angular routes, as described more fully below. All of these benefits are achieved while maintaining the same solid metal wire center conductor and 50 ohm impedance throughout the interconnection apparatus 50.

To realize robust electrical contacts between the slabline an three-wire line, a short (less than a tenth of a wavelength) section 90 of shielded three wire transmission line using compressible conductors (or "fuzz buttons") is included as the final component within this invention. The compressible conductors 92A, 92B and 92C are formed by densely packing thin wire into the openings 98A, 98B and 98C formed in the dielectric 94. In an exemplary embodiment, the compressible conductors have a nominal 20 mil diameter. The thin wire is typically gold plated molybdenum, gold plated beryllium copper, or gold plated tungsten wire, having a thickness of 1 or 2 mils. The compressible conductors 92A, 92B and 92C protrude slightly from the ends of the openings 98A–98C, and provide a compressible DC contact for the three wire conductor lines 42A, 42B and 42C comprising the three-wire I/O port 40. Potential DC open circuits in the three-wire conductor lines are prevented by the resiliency of the compressible contacts provided by the conductors 92A–92C, which compress and expand to fill gaps due to tolerance build-up in assembly. Shielded anisotropically, conducting elastomer materials such as the metal on elastomer product "MOE" marketed by Elastomer, Inc., and the product marketed as "ECPI" (electrically conductive polymer interconnect) by AT&T, can also be used for the same purpose as the compressible conductors with proper conductor orientation. Both of these alternate materials have silicone rubber elastomer embedded with conductive metal strips or particles. The metal strips or particles are arranged such that the composite material becomes electrically conductive in only one direction when pressure contact is applied. The resulting conducting "paths" will then provide the interconnections from the three wire line on the module face to the slabline center conductor and its outer shield.

The outer slabline shield 86 makes DC contact to the outer ground wires 92A and 92C of the fuzz button three-wire line 90. To prevent the possibility of generating additional higher order modes, the outer slabline shield 86 also surrounds the fuzz button three-wire line 90 while making ground contact to the module housing 46 of the I/O port 40. A conductive gasket or wire mesh (not shown in FIG. 1) is used to provide contact between the shield 86 and the housing 46.

Figure 2:
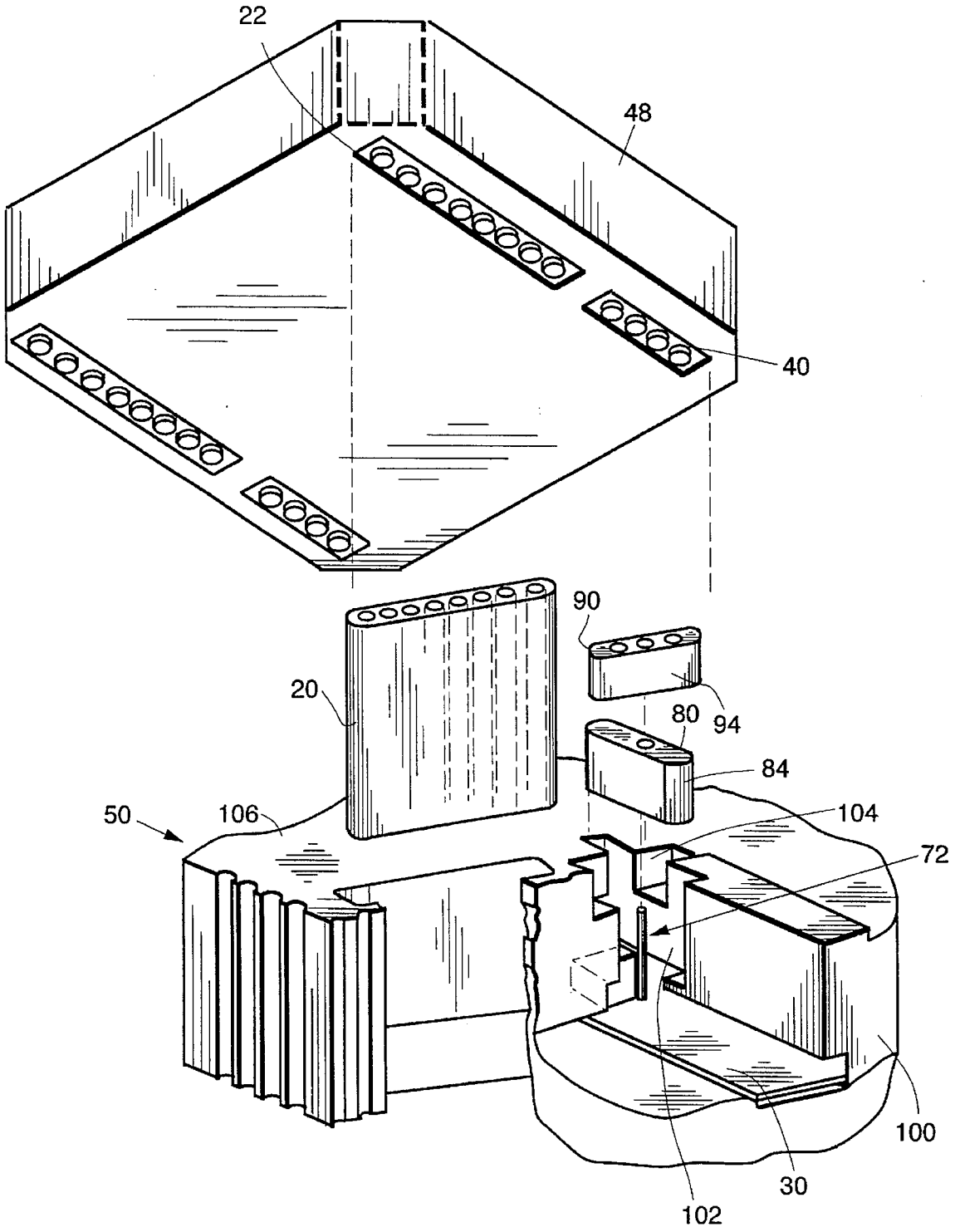
FIG. 2 is an exploded, partially broken-away isometric view of an exemplary implementation of the interconnect apparatus of FIG. 1.

FIG. 2 is an exploded, partially broken-away isometric view of an exemplary implementation of the interconnect apparatus 50. The apparatus 50 provides a vertical right angle solderless interconnect from the suspended stripline 30 to three wire line MIC substrate port 40 defined in a module housing 48, by using the slabline transmission line 80 as an intermediate transmission line between the suspended substrate stripline 30 and the orthogonal junction three wire line 40. A metal housing structure 100 provides the shielding for the various transmission lines comprising the interconnect apparatus 50. The suspended stripline 30 is illustrated as disposed generally in a horizontal plane. The orthogonal transition provides an electrical connection to the stripline center conductor. In this exemplary embodiment, the tip of the center conductor 72 is soldered to the center conductor strip of the suspended stripline. The coaxial line transition extends orthogonally to the suspended stripline 30, with the center conductor 72 extending upwardly. In this exemplary embodiment, the housing 100 defines a coaxial outer shield having a generally rectilinear cross-sectional configuration, instead of a circular configuration. The slabline dielectric 84 fits over an upwardly extending portion of the conductor 72, and is accepted in a slot open region 102 formed in the metal housing structure 100. The compressible conductor, three wire line section 90 fits transversely to the slabline dielectric 84 and adjacent a top surface 80 of the slab-line dielectric. The section 90 fits into an open slot region 104 defined in the metal housing structure 100. When assembled, the top surface 90 of the dielectric 94 is essentially flush with the top surface 106 of the housing structure 100. The three wire line 40 can then be assembled against the top surface 94A of the dielectric 94 and the top surface 106 of the housing 100. Also shown in FIG. 2 is a DC compressible conductor set 20, for providing DC interconnection.

Figure 3:
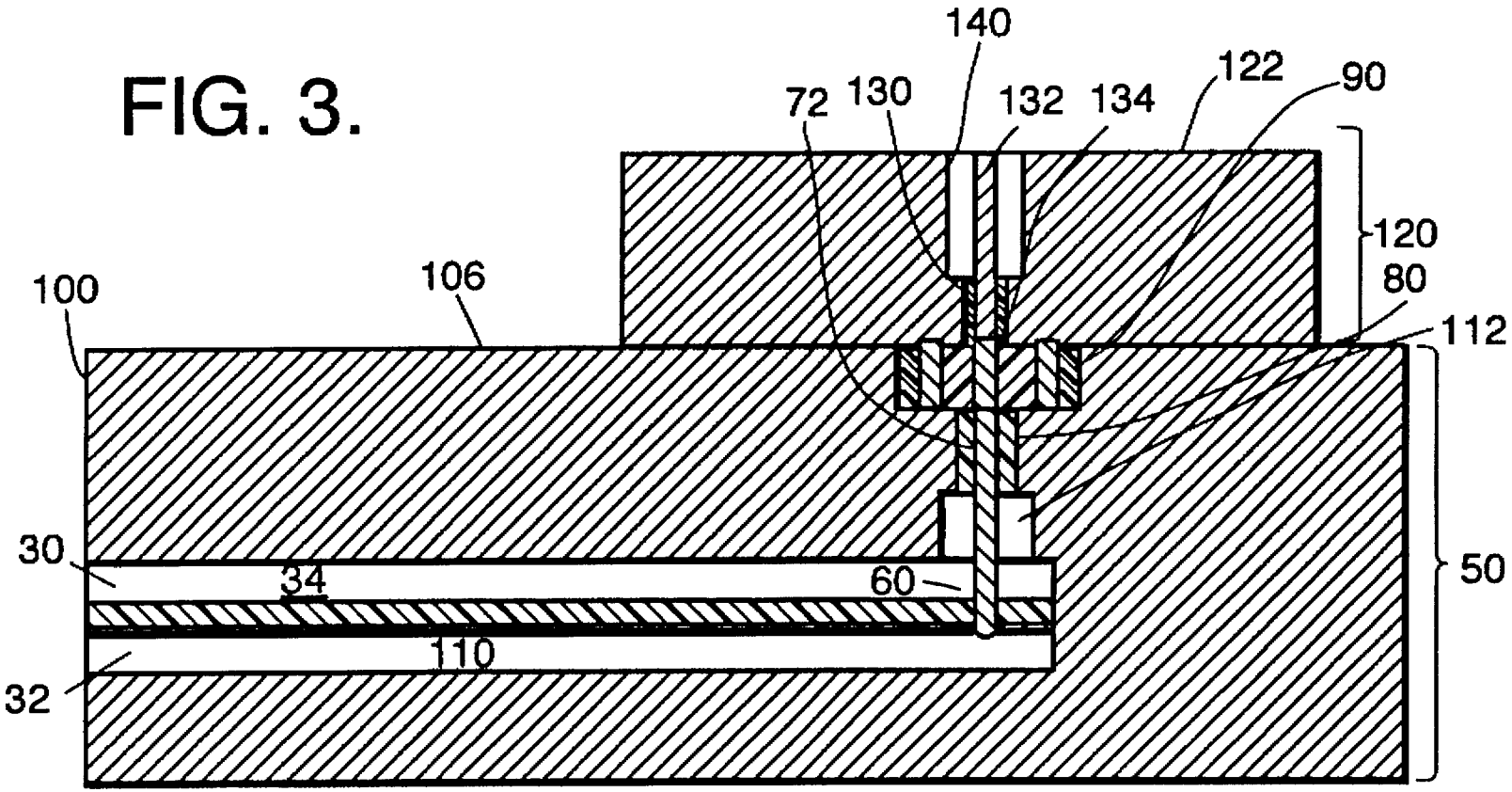
FIG. 3 is a cross-sectional view of an alternate application of the interconnect apparatus, used to provide a solderless interconnection from suspended stripline to three wire line, to slabline and then to coaxial line.

FIG. 3 is a cross-sectional view of an alternate application of the interconnect apparatus 50, used to provide a solderless interconnection from suspended stripline to three wire line, to slabline and then to coaxial line. Thus, the application shown in FIG. 3 provides an interconnect to coaxial line instead of to three wire line as in FIGS. 1 and 2. As in FIG. 2, a metal housing structure provides shielding and structural support for the transmission lines of the interconnect apparatus 50. The suspended stripline 30 with its center conductor strip 32 formed on the bottom side of the dielectric sheet 34 is suspended in the open channel 110 defined by the housing 100.

The orthogonal transition 60 is formed by the conductor 72 which extends through an opening formed in the dielectric sheet 34 and a corresponding opening formed in the conductor strip 32; the tip of the conductor 72 is soldered to the conductor strip 32. A cylindrical open area 112 formed in the housing 100 and the conductor 72 define the air coaxial line section 70. The dielectric filled slabline transition 80 is defined above the coaxial section 70, with the compressible conductor three-wire line section 90 in turn defined above the slabline transition.

Disposed directly above the three-wire line section is a slabline-coaxial line transition structure 120. A metal housing structure 122 is affixed with a lower planar surface 124 against the upper surface 106 of the housing 100. A slabline transmission line section 130 is defined by a dielectric 134 and center conductor 132, the dielectric fitted into a slot opening formed in the housing 120 of a generally rectangular configuration similar to that of transition 80. The narrow dimension of the slabline is disposed transversely to the narrow dimension of the three wire line section 90, in a similar configuration to the slabline 80. The conductor 132 continues upwardly to a coaxial line section 140, forming the center conductor of the coaxial line.

The application illustrated in FIG. 3 provides a solderless interconnection between a horizontally disposed suspended stripline circuit and an orthogonally oriented coaxial line. The similarity of electric field orientation and distribution produces a well matched transition.

Figure 4C:
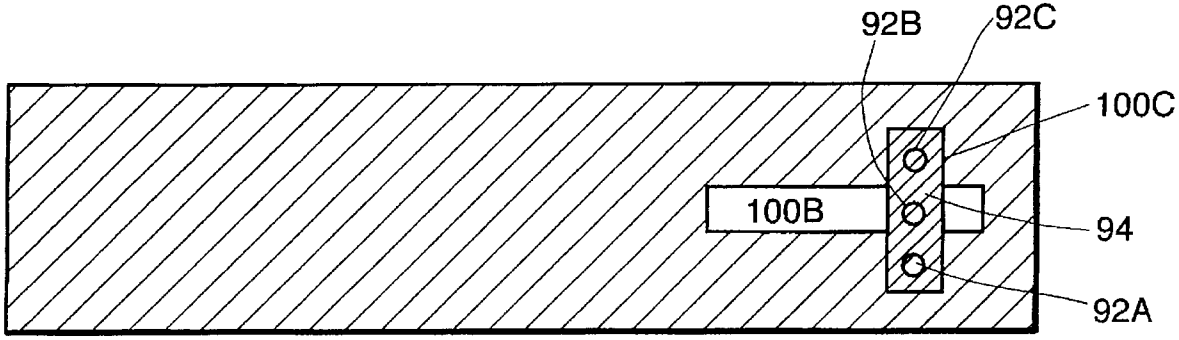
FIG. 4C is a top view of the alternate embodiment.
Figure 4B:
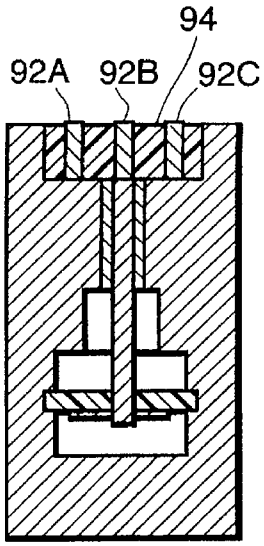
FIGS. 4A–4B are respective side and end cross-sectional diagrams of an alternate embodiment of the interconnection apparatus providing translational offset.
Figure 4A:
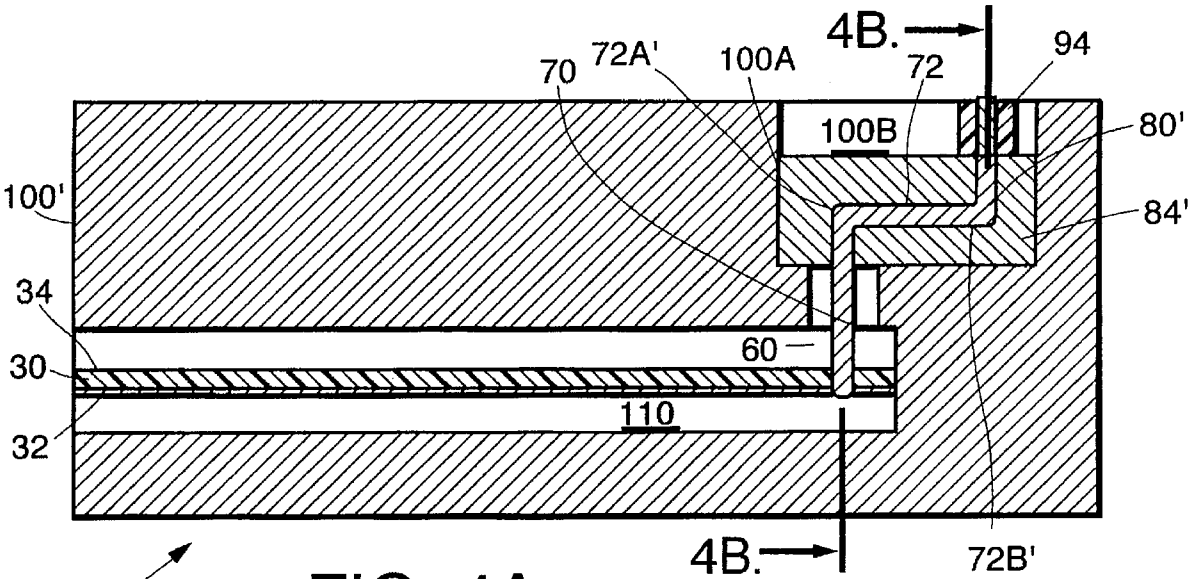

An added benefit of the slabline transition comprising the interconnection apparatus is the capability to incorporate translational and angular offsets. FIGS. 4A–4C illustrate an exemplary embodiment 50' of the interconnection apparatus which incorporates a translational offset in the slabline center conductor. The metal housing 100' supports the suspended stripline 30 in the open channel 110. The orthogonal transition 60 and coaxial line section 70 are identical to the corresponding elements shown in FIG. 3. The slabline section 80' incorporates a slabline offset transition in the center conductor 72' with jogs 72A' and 72B'. The dielectric 84' surrounds the conductor 72' in the slabline region. The three wire transmission line section 90 with the compressible conductors 92A–92C fits atop the slabline 80' with the conductor 92B in contact with the end of the center conductor 72'. The housing 100' includes an open slot cavity region 100A into which the dielectric 84' is inserted, leaving a cavity 100B after the insertion. The dielectric body 94 of the three wire section 90 is fitted into a slot 100C defined in the housing 100' transverse to the slot region 100A, as shown in FIG. 4C.

Figure 5B:
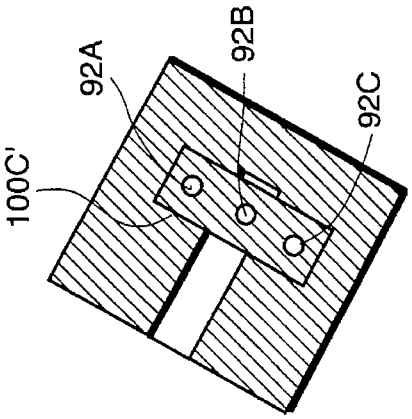
FIG. 5B is a view of the apparatus of FIG. 5A taken at an angle.
Figure 5C:
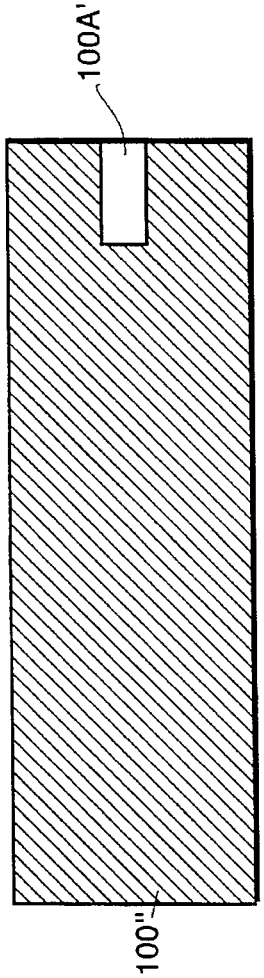
FIG. 5C is a top view of the alternate embodiment.
Figure 5A:
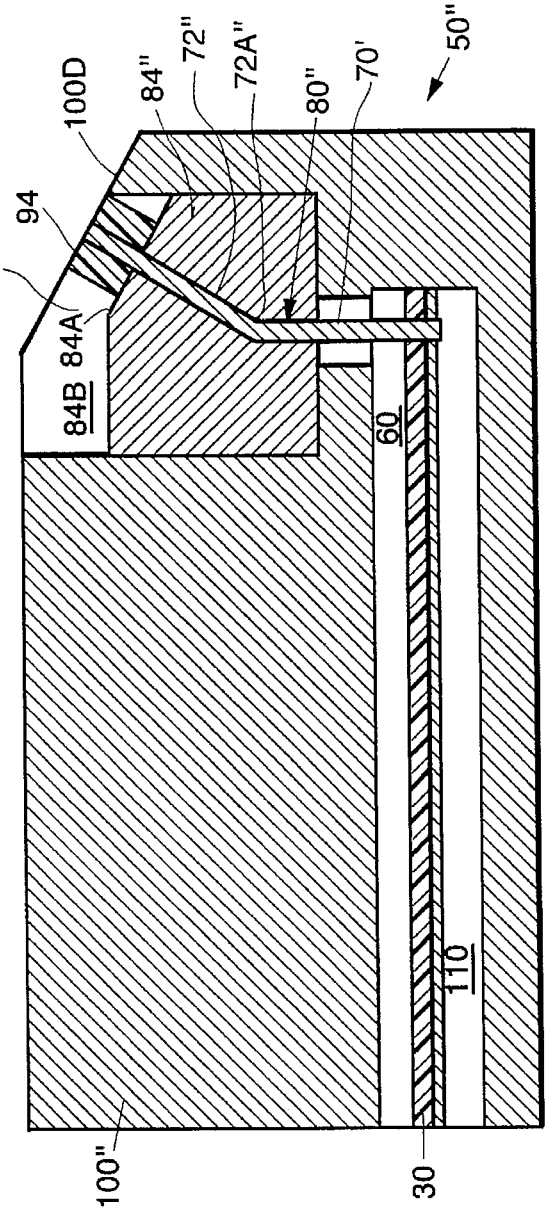
FIG. 5A is a side cross-sectional view of an alternate embodiment of the interconnection apparatus providing angular offset.

FIGS. 5A–5C illustrate an exemplary embodiment 50" of the interconnection apparatus which incorporates an angular offset in the slabline center conductor. The metal housing 100" supports the suspended stripline 30 in the open channel 110. The orthogonal transition 60 and coaxial line section 70 are identical to the corresponding elements shown in FIG. 3. The slabline section 80" incorporates a slabline offset transition in the center conductor 72" with jog 72A" formed in the center conductor. The dielectric 84" surrounds the conductor 72" in the slabline region, and includes a beveled edge surface 84A. The three wire transmission line section 90 with the compressible conductors 92A–92C fits atop the slabline 80" with the conductor 92B in contact with the end of the center conductor 72". The housing 100" includes an open slot cavity region 100A' into which the dielectric 84" is inserted, leaving a cavity 100B' after the insertion, and also includes a beveled edge 100D. The dielectric body 94 of the three wire section 90 is fitted into a slot 100C' define din the housing 100" transverse to the slot region 100A', as shown in FIG. 5B. Thus, by incorporating a jog in the center conductor 72", and with a beveled edge in the housing structure 100", an angular offset in the interconnection apparatus is provided, providing additional flexibility in interconnecting different modules/circuits.

Figure 6:
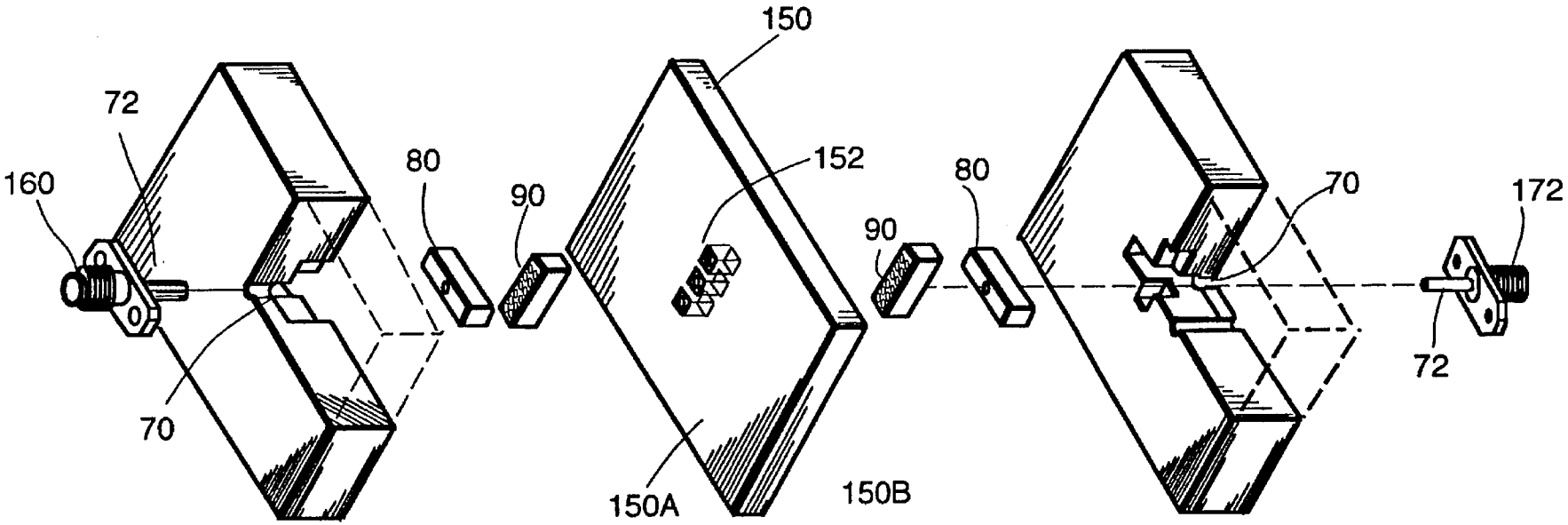
FIG. 6 is an exploded isometric view showing how the invention can be used to create a stacked assembly by sandwiching an MIC module with three-wire line input/output ports located on both of its broad faces.

FIG. 6 shows how the invention can be used to create a stacked assembly by sandwiching an MIC module 150 with three-wire line input/output ports (only port 152 is visible in FIG. 6) located on both of its broad faces 150A and 150B. The three wire compressible contact line section 90 makes contact with the wire terminals of port 152. A slabline transition 80 and coaxial line section 70 with center conductor 72 complete the transition to a coaxial port 160. Similar elements are used to make the transition to coaxial port 170.

The invention provides a low loss, minimal space, low cost, vertical transition between vertically stacked modules and circuit. Because of its solderless nature, stacked microwave hybrid and stripline assemblies that are more easily assembled and disassembled for rework can be realized. Applications include vertical interconnects between stacked module assemblies, which can be found in receiver/exciters, communications subsystems, and other microwave circuitry. Such circuitry can be found in radar systems, satellites, microwave automobile electronics, missile systems, and other applications where size limitations are important. An exemplary application of the invention is the multi-port interconnections from the planar suspended substrate stripline antenna corporate feed network into the T/R modules of an active array antenna system. Another application is the interconnections at the radiator aperture interface to the T/R modules of the active array antenna system.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A microwave interconnection apparatus for providing RF interconnection between a suspended stripline transmission line and a three wire transmission line, comprising:

a coaxial line transition coupled to the suspended stripline transmission line, said coaxial line transition including a coaxial center conductor member and an outer conductor shield spaced from the center conductor;

a dielectric filled slabline transition having a first port adjacent a port of the coaxial line transition, the slabline transition including a dielectric member, a slabline center conductor member and an outer conductive shield member defining a cavity in which the dielectric member is disposed, the cavity having a generally rectilinear cross-sectional configuration;

wherein the coaxial outer conductor shield is adjacent the slabline shield member;

a three wire transmission line transition section having a first port in electrical communication with a second port of the slabline transition and including a middle wire and respective first and second ground wires flanking the middle wire, the ground wires in electrical contact with the outer shield member of the slabline transition.

2. The interconnection apparatus of claim 1 wherein the middle wire and first and second ground wires of the three wire transmission line transition section are compressible conductor members.

3. The interconnection apparatus of claim 1 wherein the slabline transition has a narrow dimension oriented in a first direction, said three wire transition section has a narrow dimension oriented in a second direction, and said first direction is transverse to said second direction.

4. The interconnection apparatus of claim 1 wherein the three wire transition section has an effective electrical length which does not exceed one tenth of a wavelength of operation of the interconnection apparatus.

5. The interconnection apparatus of claim 1 wherein the suspended substrate stripline transmission line includes a center conductor strip, and said coaxial transmission line section is connected to the center conductor strip by an orthogonal transition.

6. The interconnection apparatus of claim 1 wherein the center conductor of the coaxial line transition and the center conductor of the slabline transition comprise an integral conductor element.

7. The interconnection apparatus of claim 6 wherein the integral conductor element has a constant diameter through the coaxial line transition and the slabline transition.

8. The interconnection apparatus of claim 1, further comprising an electrically conductive housing structure, said housing structure supporting said suspended stripline transmission line and defining said outer shield of said coaxial line transition and said outer shield of said slabline transition.

9. The interconnection apparatus of claim 1 wherein the three wire transition section has an output port axis which is orthogonal to said suspended stripline transmission line.

10. The interconnection apparatus of claim 1 wherein the center conductor of said slabline transition includes an offset, and said three wire transition section has an output port axis which is orthogonal to said suspended stripline transmission line and offset from an axis of said coaxial line transition.

11. The interconnection apparatus of claim 1 wherein the center conductor of said slabline transition includes a bend, and said three wire transition section has an output port axis which is disposed at an angle to a plane established by said suspended stripline transmission line.

12. The interconnection apparatus of claim 1 wherein said coaxial line transition, said slabline transition and said three wire transition are joined together and to said suspended stripline transmission line and said three wire transmission line in solderless connections.

13. The interconnection apparatus of claim 1 wherein the coaxial outer conductor shield has a generally circular cross-sectional configuration.

14. A microwave interconnection apparatus for providing RF interconnection between a suspended stripline transmission line and a three wire transmission line, comprising:

a coaxial line transition coupled to the suspended stripline transmission line, said coaxial line transition including a coaxial center conductor member and an outer conductor shield spaced from the center conductor and having a generally circular cross-section configuration;

a dielectric filled slabline transition having a first port adjacent a port of the coaxial line transition, the slabline transition including a dielectric member, a slabline center conductor member and an outer conductive shield member defining a cavity in which the dielectric member is disposed, the cavity having a generally rectilinear cross-sectional configuration;

wherein the coaxial outer conductor shield is adjacent the slabline shield member; and a three wire transmission line transition section having a first port in electrical communication with a second port of the slabline transition and including a middle wire and respective first and second ground wires flanking the middle wire, the ground wires in electrical contact with the outer shield member of the slabline transition, the ground and middle wires fabricated of a compressible conductor material, and wherein the three wire transmission line section has an electrical length which does not exceed one tenth of a wavelength at which the interconnection apparatus is operated; and wherein said coaxial transition, said slabline transition and said three wire transition are coupled together without solder connections.

15. The interconnection apparatus of claim 14 wherein the slabline transition has a narrow dimension oriented in a first direction, said three wire transition section has a narrow dimension oriented in a second direction, and said first direction is transverse to said second direction.

16. The interconnection apparatus of claim 14 wherein the suspended substrate stripline transmission line includes a center conductor strip, and said coaxial line transition is connected to the center conductor strip by an orthogonal transition.

17. The interconnection apparatus of claim 14 wherein the center conductor of the coaxial line transition and the center conductor of the slabline line transition comprises an integral conductor element.

18. The interconnection apparatus of claim 17 wherein the integral conductor element has a constant diameter through the coaxial line transition and the slabline transition.

19. The interconnection apparatus of claim 14, further comprising an electrically conductive housing structure, said housing structure supporting said suspended stripline transmission line and defining said outer shield of said coaxial line transition and said outer shield of said slabline transition.

20. The interconnection apparatus of claim 14 wherein the three wire transition section has an output port axis which is orthogonal to said suspended stripline transmission line.

21. The interconnection apparatus of claim 14 wherein the center conductor of said slabline transition includes an offset, and said three wire transition section has an output port axis which is orthogonal to said suspended stripline transmission line and offset from an axis of said coaxial line transition.

22. The interconnection apparatus of claim 14 wherein the center conductor of said slabline transition includes a bend, and said three wire transition section has an output port axis which is disposed at an angle to a plane established by said suspended stripline transmission line.

* * * * *